US010526050B1

(12) United States Patent
Turek et al.

(10) Patent No.: US 10,526,050 B1
(45) Date of Patent: Jan. 7, 2020

(54) SHALLOW WATER ANCHOR WITH HYDRAULIC ACTUATION

(71) Applicants: Craig Edwin Turek, Good Thunder, MN (US); Jason Robert Woodruff, Mankato, MN (US); Wesley Calvin Marcus, Saint Peter, MN (US); Ronald Phillip Hansen, Mapleton, MN (US); David Gerald Liverseed, Mankato, MN (US); Justin Lane Alders, Madison Lake, MN (US); Janusz Stanislaw Komor, Marietta, GA (US)

(72) Inventors: Craig Edwin Turek, Good Thunder, MN (US); Jason Robert Woodruff, Mankato, MN (US); Wesley Calvin Marcus, Saint Peter, MN (US); Ronald Phillip Hansen, Mapleton, MN (US); David Gerald Liverseed, Mankato, MN (US); Justin Lane Alders, Madison Lake, MN (US); Janusz Stanislaw Komor, Marietta, GA (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 16/134,044

(22) Filed: Sep. 18, 2018

(51) Int. Cl.
*B63B 21/26* (2006.01)
*B63B 21/30* (2006.01)

(52) U.S. Cl.
CPC ..... *B63B 21/26* (2013.01); *B63B 21/30* (2013.01)

(58) Field of Classification Search
CPC ..... B63B 21/26; B63B 21/30
See application file for complete search history.

(56) References Cited

U.S. PATENT DOCUMENTS

| | | | | |
|---|---|---|---|---|
| 2,536,908 | A | 1/1951 | Chadwick | |
| 3,580,082 | A * | 5/1971 | Strack | G01L 9/0077 73/705 |
| 4,073,078 | A | 2/1978 | Leitz | |
| 4,237,808 | A | 12/1980 | Doerffer | |
| 4,254,730 | A | 3/1981 | Crenshaw | |
| 4,566,135 | A * | 1/1986 | Schmidt | H04R 23/008 381/111 |
| RE32,297 | E | 12/1986 | Oules | |
| 4,892,445 | A | 1/1990 | Paige | |
| 6,041,730 | A * | 3/2000 | Oliverio | B63B 21/26 114/230.13 |
| 6,895,884 | B1 * | 5/2005 | Velazquez | B63B 21/26 114/295 |
| 7,647,878 | B1 | 1/2010 | Santiago | |
| 7,699,014 | B1 | 4/2010 | Harrison | |
| 7,827,927 | B2 | 11/2010 | Kivi | |

(Continued)

*Primary Examiner* — S. Joseph Morano
*Assistant Examiner* — Jovon E Hayes
(74) *Attorney, Agent, or Firm* — Reinhart Boerner Van Deuren P.C.

(57) ABSTRACT

A shallow water anchor and related methods are provided. The shallow water anchor includes a four-bar linkage and a hydraulic actuator for actuating the four-bar linkage. An anchoring element is connected to the four-bar linkage. A hydraulic control arrangement operates the hydraulic actuator to transition the hydraulic actuator between stowed and deployed positions and vice versa. The shallow water anchor can incorporate a controller which monitors a current limit, a pressure limit, or both to perform a variety of anchoring functions.

25 Claims, 10 Drawing Sheets

(56) References Cited

U.S. PATENT DOCUMENTS

| | | | | |
|---|---|---|---|---|
| 7,861,661 | B2 | 1/2011 | Beaty | |
| 7,870,829 | B1 | 1/2011 | Perry et al. | |
| 7,921,794 | B1 | 4/2011 | Cullom et al. | |
| 7,971,548 | B2 * | 7/2011 | Kuenzel | B63B 21/00 114/294 |
| 8,082,869 | B2 | 12/2011 | Beaty | |
| 8,312,832 | B1 | 11/2012 | Camp | |
| 8,381,671 | B2 * | 2/2013 | Bernloehr | B63B 21/30 114/294 |
| 8,495,963 | B2 * | 7/2013 | Bernloehr | B63B 21/26 114/230.13 |
| 8,550,023 | B1 | 10/2013 | Quail | |
| 8,661,999 | B2 | 3/2014 | Blom | |
| 8,677,919 | B2 | 3/2014 | Bernloehr et al. | |
| 8,733,268 | B2 | 5/2014 | Beaty | |
| 8,776,712 | B2 * | 7/2014 | Bernloehr | B63B 21/26 114/295 |
| 8,800,465 | B1 | 8/2014 | Quail | |
| 8,943,990 | B2 | 2/2015 | McQuade | |
| 9,145,188 | B1 | 9/2015 | Daneman | |
| 9,187,152 | B2 | 11/2015 | Bailey et al. | |
| 9,284,024 | B2 | 3/2016 | Kuenzel | |
| 9,434,452 | B2 | 9/2016 | Bernloehr et al. | |
| 9,517,827 | B2 * | 12/2016 | Shamblin | B63H 25/44 |
| 9,663,191 | B2 | 5/2017 | Cromartie | |
| 9,745,022 | B1 | 8/2017 | Kuenzel | |
| 9,969,468 | B2 * | 5/2018 | Price, III | B63B 27/146 |
| 2009/0223429 | A1 * | 9/2009 | Kuenzel | B63B 21/00 114/230.13 |
| 2009/0223430 | A1 * | 9/2009 | Kuenzel | B63B 21/24 114/230.13 |
| 2011/0107952 | A1 | 5/2011 | Nicholson, IV | |
| 2011/0209656 | A1 * | 9/2011 | Bernloehr | B63B 21/26 114/293 |
| 2015/0298771 | A1 | 10/2015 | Kuenzel | |
| 2017/0233039 | A1 | 8/2017 | Kuenzel | |
| 2017/0247089 | A1 * | 8/2017 | Price, III | B63B 27/146 |
| 2018/0312227 | A1 * | 11/2018 | Price, III | B63B 21/29 |

* cited by examiner

SHALLOW WATER ANCHOR WITH HYDRAULIC ACTUATION

FIELD OF THE INVENTION

This invention generally relates to marine devices, and more particularly to anchors for watercraft, and even more particularly to shallow water anchors.

BACKGROUND OF THE INVENTION

Shallow water anchors are used in commercial and recreational applications to anchor a watercraft in relatively shallow bodies of water. Anchors of this type have the advantages of being easy to manipulate, relatively quiet in their operation, and having a small power requirement to stow and to deploy. One example of a contemporary shallow water anchor may be readily seen at U.S. Pat. No. 8,776,712 to Bernloehr et al. titled "Shallow Water Anchor," the teachings and disclosure of which are incorporated by reference in their entirety herein.

Such shallow water anchors may be transitioned from a stowed position to deployed position and vice versa by a variety of methods. For example, as is done in U.S. Pat. No. 8,776,712, a mechanical actuation can be utilized wherein an electric motor drives a mechanical system to transition the anchor. As another example, the anchor may be transitioned from a stowed position to a deployed position using a hydraulically actuated configuration.

Mechanically actuated configurations such as those mentioned above have the advantage of allowing for a variety of additional anchoring functions such as auto-bottom detection, auto-packing to ensure sufficient anchor insertion, and rough water compensation. Hydraulically actuated systems, on the other hand, do not heretofore offer such additional functionality but instead provide all the advantages of utilizing hydraulics.

While shallow water anchors of the type introduced above remain an effective means for anchoring a watercraft in shallow bodies of water, there remains a need in the art for improvements in such hydraulically actuated shallow water anchors in terms of their ability to deal with turbulent waters, anchoring functions, and control. The invention provides such improvements for a hydraulically actuated shallow water anchor. These and other advantages of the invention, as well as additional inventive features, will be apparent from the description of the invention provided herein.

BRIEF SUMMARY OF THE INVENTION

In one aspect, the inventions provides a shallow water anchor. An embodiment of such a shallow water anchor includes a four-bar linkage that has first end configured for mounting to a watercraft. The shallow water anchor also includes at least one hydraulic actuator operably connected to the four-bar linkage for transitioning the shallow water anchor from a stowed position to a deployed position and from deployed position to a stowed position. The shallow water anchor also includes an anchoring element mounted at a second end of the four-bar linkage. The shallow water anchor also includes a hydraulic control arrangement operably coupled to the hydraulic actuator to control the hydraulic actuator. The hydraulic control arrangement includes a pressure transducer to provide closed loop control of the shallow water anchor.

In embodiments according to this aspect, the four-bar linkage includes a first arm, a second arm arranged in parallel to the first arm, and a mounting arm connected to the first and second arms. The mounting arm defines the first end of the four-bar linkage. The four-bar linkage also includes an anchor arm arranged in parallel to the mounting arm and connected to the first and second arms. The anchor arm defines the second end of the four-bar linkage. The hydraulic actuator is connected to the first arm and the second arm. An interior space is defined between the first and the second arms in the stowed position and in the deployed position. The hydraulic actuator is contained within the interior space. At least one stabilization bar can also be provided between the first and second arms within the interior space.

In embodiments according to this aspect, the mounting arm and anchor arm each include a plurality of interior support ribs.

In embodiments according to this aspect, the hydraulic actuator can be a double-acting cylinder hydraulic actuator.

In embodiments according to this aspect, the hydraulic control arrangement includes a pump, a flow manifold, and a reservoir. The pump is operable to convey hydraulic fluid from the reservoir through the flow manifold along a first flow path and a second flow path. The first flow path includes a first check valve arranged to prevent a flow of hydraulic fluid from the hydraulic actuator back towards the reservoir along the first flow path. The second flow path includes a second check valve arranged to prevent a flow of hydraulic fluid from the hydraulic actuator back towards the reservoir along the second flow path. A shuttle spool is interposed between the first and second check valves within the flow manifold and is operable to bias one of the first or second check valves open when the other one of the first or second check valves is opened due to a hydraulic fluid pressure.

In embodiments according to this aspect, the pressure transducer is in fluid communication with at least one of the first and second flow paths to detect a hydraulic fluid pressure. The pressure transducer can be mounted to the flow manifold. The pressure transducer is configured to provide a signal to a controller for closed loop control of the shallow water anchor.

In another aspect, a shallow water anchor is provided. An embodiment of such a shallow water anchor includes a four-bar linkage having a first end configured for mounting to a watercraft. The system also includes at least one hydraulic actuator connected to the four-bar linkage, and anchoring element mounted at a second end of the four-bar linkage. The system also includes a hydraulic control arrangement operably coupled to the hydraulic actuator to control said hydraulic actuator which includes a pump, a flow manifold, and a reservoir. The pump is operable to convey hydraulic fluid from the reservoir through the flow manifold along a first flow path and a second flow path. The first flow path includes a first check valve arranged to prevent a flow of hydraulic fluid from the hydraulic actuator back towards the reservoir along the first flow path. The second flow path includes a second check valve arranged to prevent a flow of hydraulic fluid from the hydraulic actuator back towards the reservoir along the second flow path. A shuttle spool is interposed between the first and second check valves within the flow manifold and is operable to bias one of the first or second check valves open when the other one of the first or second check valves is opened due to a hydraulic fluid pressure.

In embodiments according to this aspect, the four-bar linkage includes a first arm, a second arm arranged in relative to the first arm, and a mounting arm connected to the first and second arms. The mounting arm defines the first end of the four-bar linkage. The four-bar linkage also includes an anchor arm arranged in parallel to the mounting arm and connected to the first and second arms. The anchor arm defines the second end of the four-bar linkage. The hydraulic actuator is connected to the first arm and the second arm.

In embodiments according to this aspect, the shallow water anchor also includes a controller for monitoring at least one signal corresponding to a current supplied to the pump and a fluid pressure along one of the first and second flow paths. The hydraulic control arrangement includes a pressure transducer that is in fluid communication with at least one of the first and second flow paths to detect a hydraulic fluid pressure. The pressure transducer provides the at least one signal corresponding to the fluid pressure in at least one of the first and second flow paths.

In embodiments according to this aspect, the controller is configured to control operation of the pump of the hydraulic control arrangement based on the at least one signal received.

In embodiments according to this aspect, the hydraulic control arrangement includes a first thermal relieve valve and a first high pressure relief valve arranged in fluid communication with the first flow path, and a second thermal relief valve and a second high pressure relief valve in fluid communication with the second flow path. A first manual bypass valve may also be provided in fluid communication with the first flow path, and a second manual bypass valve may also be provided in fluid communication with the second flow path.

In yet another aspect, the invention provides a method of operating a shallow water anchor that has a four-bar linkage, an anchoring element coupled to the four-bar linkage, a hydraulic actuator coupled to the four-bar linkage to change a configuration of the four-bar linkage, and a hydraulic control arrangement for controlling the hydraulic actuator. An embodiment of such a method includes extending a length of the hydraulic actuator via a supply of hydraulic fluid from the hydraulic control arrangement until the anchoring element contacts a bottom surface, determining at least one of a current limit and a pressure limit, and monitoring for whether or not at least one of the current limit or the pressure limit is met.

In certain embodiments according to this aspect, the method also includes repeating, at least once, the steps of extending, determining, and monitoring, after at least one of the current limit or the pressure limit is met.

In embodiments according to this aspect, the step of determining at least one of a current limit and a pressure limit includes identifying, with a controller, a rate of change in current or a rate of change in pressure.

In embodiments according to this aspect, the step of determining at least one of a current limit and a pressure limit includes setting a current limit or a pressure limit based on a look-up table value stored in a memory of the controller.

In embodiments according to this aspect, the step of determining at least one of a current limit and a pressure limit includes setting a current limit or a pressure limit based the magnitude of the rate of change in current or the rate of change in pressure.

In embodiments according to this aspect, the step of repeating, at least once, the steps of extending, determining, and monitoring includes repeating a predetermined number of times based on a value saved in memory of the controller.

In embodiments according to this aspect, the step of repeating, at least once, the steps of extending, determining, and monitoring includes initiating the step of repeating upon detection by the controller of a pressure value which is below a minimum pressure value.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, an exemplary embodiment of a shallow water anchor is shown and described. Additionally, several exemplary operational modes are also shown and described. As will be understood from the following, the shallow water anchor described herein advantageously allows for the implementation of a variety of anchoring functions in the context of a hydraulically actuated anchor.

Figure 1:
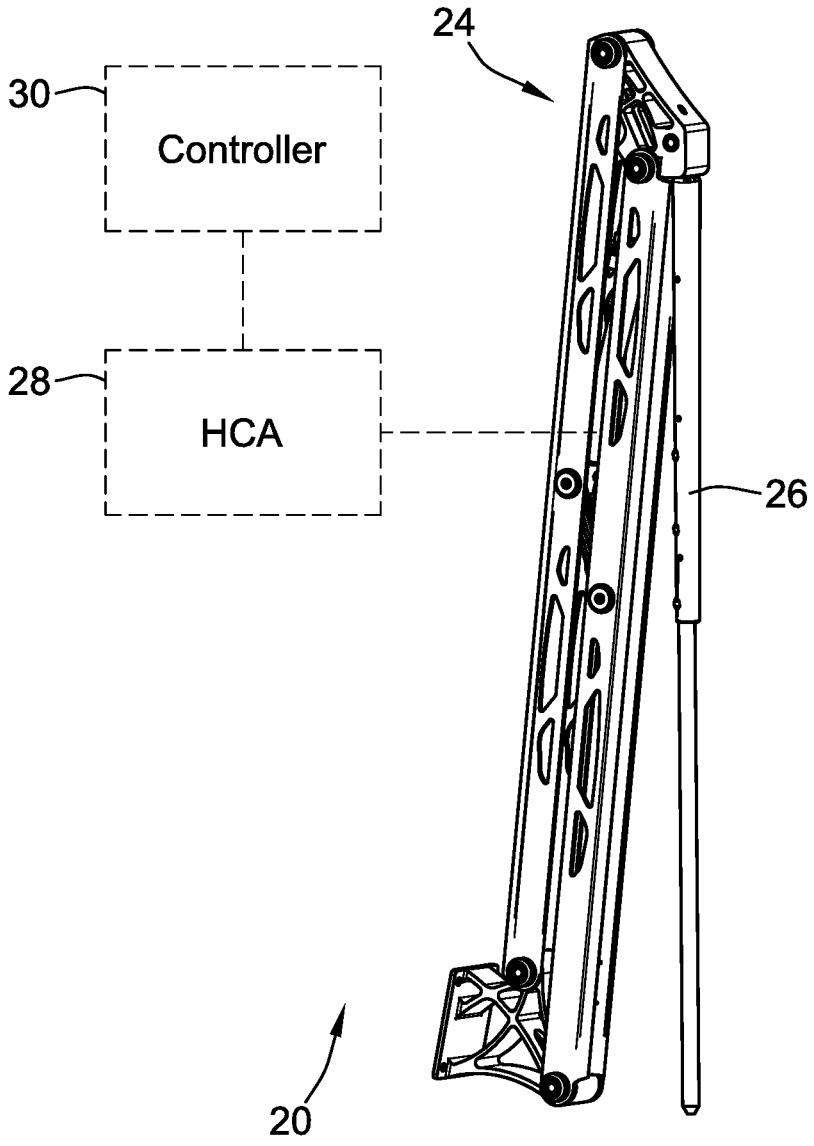
FIG. 1 is a side view of an exemplary embodiment of a shallow water anchor according to the teachings herein, with a shallow water anchor of the system illustrated in a stowed position.

With particular reference to FIG. 1, an exemplary embodiment of a shallow water anchor 20 is shown and described. Shallow water anchor 20 can be transitioned from its stowed position shown in FIG. 1, to its deployed position shown in FIG. 3. To achieve such a configuration change, shallow water anchor 20 includes a four-bar linkage 24. As discussed below, four-bar linkage 24 has a first end which is configured to mount to a watercraft. Such configuration may include providing a mounting surface, mounting holes, or any other mounting feature useful for mounting four-bar linkage directly to a surface of a watercraft, e.g. the transom, or an intermediary structure, e.g. a mounting bracket, attached to the watercraft.

Shallow water anchor 20 also includes an anchor element 26 attached at a second end of four bar linkage 24. Anchor element 26 is illustrated generally as a spike, but may include other features such as for tines, etc., to aid in anchoring. Further, anchor element 26 may be monolithic, or may be formed from several parts. Anchor element 26 may also be adjustable in length so that a maximum anchoring depth may be varied.

Shallow water anchor 20 also includes a hydraulic control arrangement (HCA) 28 which is schematically shown in FIG. 1. As discussed in the following, HCA 28 includes a pump, a flow manifold, and a reservoir. As used herein, the term "pump" includes not only mechanical elements of the pump itself, but also the motor used for driving the mechanical elements of the pump to provide pumping functionality. HCA 28 supplies hydraulic fluid to a hydraulic actuator 40 (See FIG. 2) which is responsible for transitioning shallow water anchor 20 between its stowed position and its deployed position, and vice versa. HCA 28 may also include a pressure transducer to monitor a hydraulic fluid pressure of fluid supplied to actuator 40. The inclusion of such a pressure transducer allows for closed loop control fluid pressure supplied to shallow water anchor 20 for control of certain functions of shallow water anchor 20, as discussed in the following. However, it is envisioned that shallow water anchor 20 need not include a pressure transducer in certain embodiments. It is also envisioned that HCA 28 and actuator 40, although illustrated and described as separate components which are remote from one another, could also be an integral configuration wherein HCA 28 and actuator 40 are a single unit.

A controller 30 may also be associated with shallow water anchor 20. As used herein, the term "controller" means any hardware, software, or firmware or combination thereof which can be utilized to control the functionality of shallow water anchor 20 described herein. As one example, controller 30 may be a stand-alone controller integrated with shallow water anchor 20 such that it is provided therewith. In such a configuration, controller 30 may also communicated via a wired or wireless connection with other devices, e.g. multi-function displays, mobile devices, etc., to allow such other devices to provide input commands to controller 30.

Alternatively, controller 30 may be entirely separate from shallow water anchor 20. For example, controller 30 may include an application installed on a device remote from shallow water anchor 20. As a non-limiting example, a user could download and install an application on the multi-function display of their watercraft and control shallow water anchor 20. As another non-limiting example, controller 30 could be embodied as a mobile device with an associated application installed. As such, it is envisioned that shallow water anchor 20 need not be provided with its own stand-alone controller 30.

Figure 2:
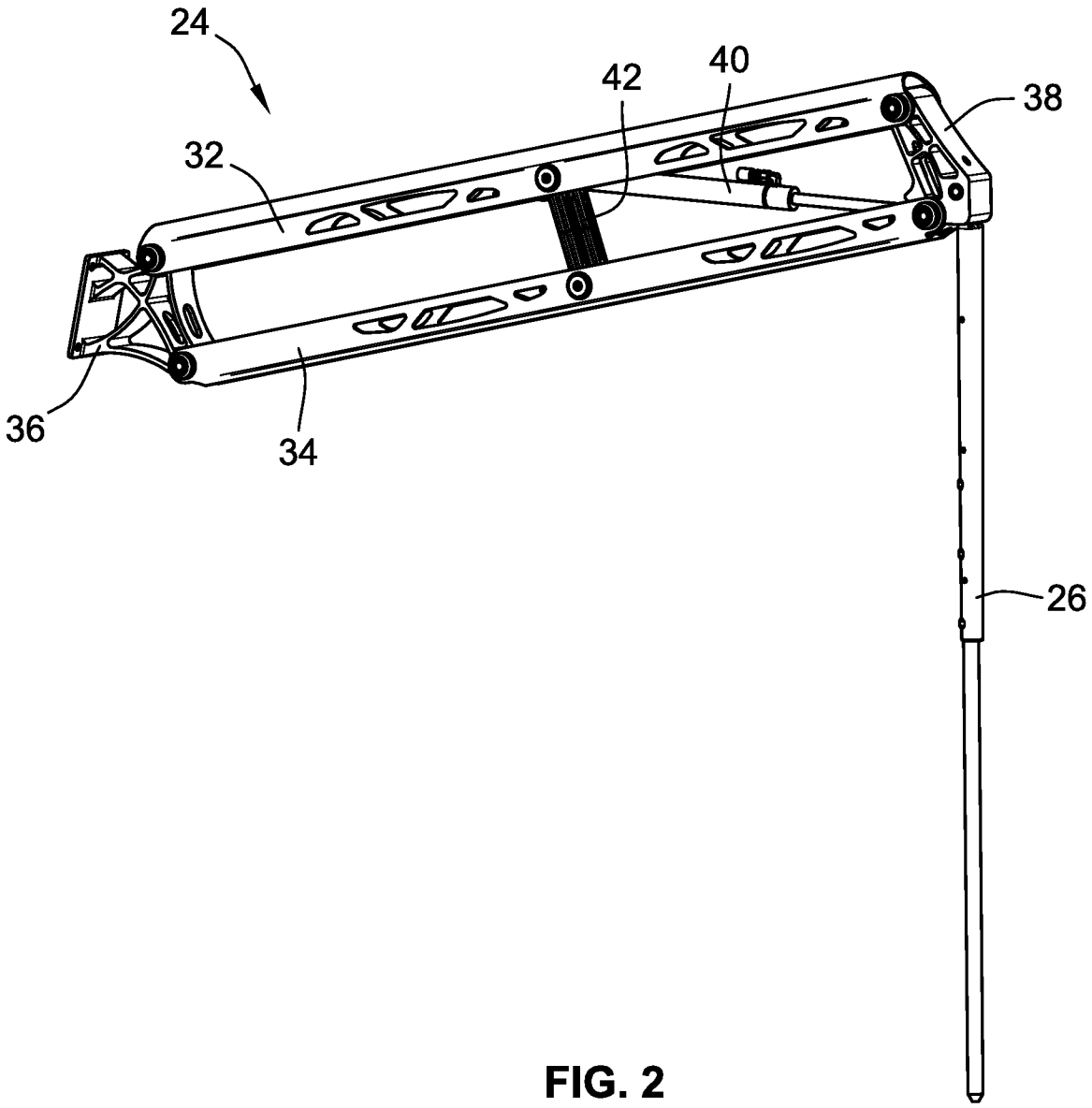
FIG. 2 is a side view of the system of FIG. 1, with the shallow water anchor transitioning from the stowed position to a deployed position.

Turning now to FIG. 2, shallow water anchor 20 is shown mid-transition between its stowed position of FIG. 1, and its deployed position of FIG. 2. Four-bar linkage 24 includes a first bar 32 and a second bar 34 parallel to first bar 32. These first and second bars 24, 34 each have an elongate interior space such that they enclose hydraulic actuator 40 in the stowed position. Further one or more reinforcement bars 42 may also be provided between first and second bars 32, 34 for structural support.

Figure 3:
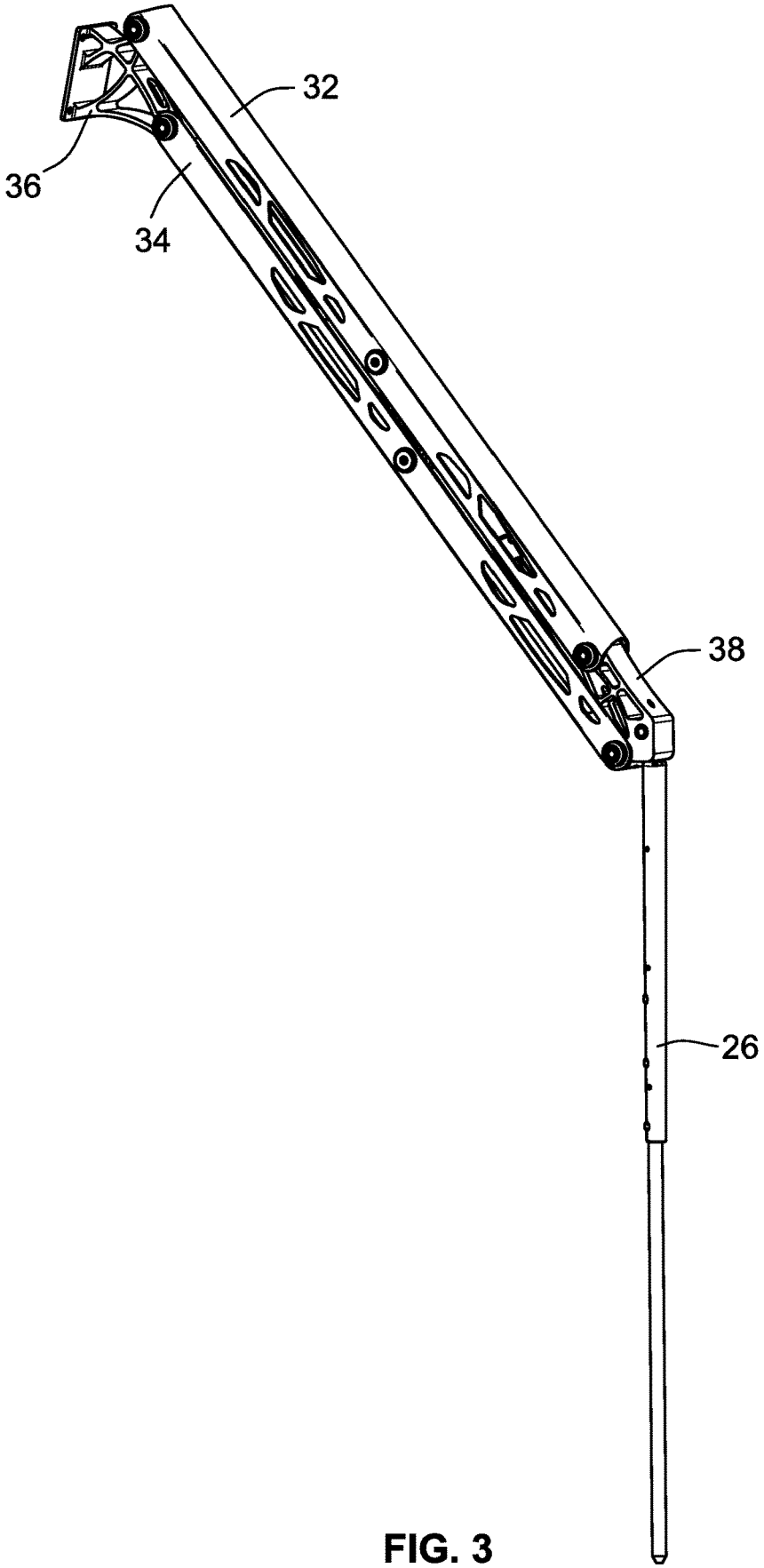
FIG. 3 is a side view of the shallow water anchor of FIG. 1, with the shallow water anchor illustrated in the deployed position.

With reference to FIG. 3, four-bar linkage 24 also includes a mounting bar 36 that defines the above referenced first end of four-bar linkage 24. Four-bar linkage 24 also includes an anchor bar 38 which defines the above referenced second end of four-bar linkage 24. Mounting bar 36 and anchor bar 38 have the same effective lengths between their respective connection points to first bar 32 and second bar 34. The same is true for first and second bars 32, 34 in that their lengths are also equal. As such, four bar linkage 24 is a parallelogram type four-bar linkage. As may also be seen in this view, mounting bar 36 and anchor bar 38 may each include a plurality of reinforcement ribs to provide strength to these structures, while keeping them light.

Figure 4:
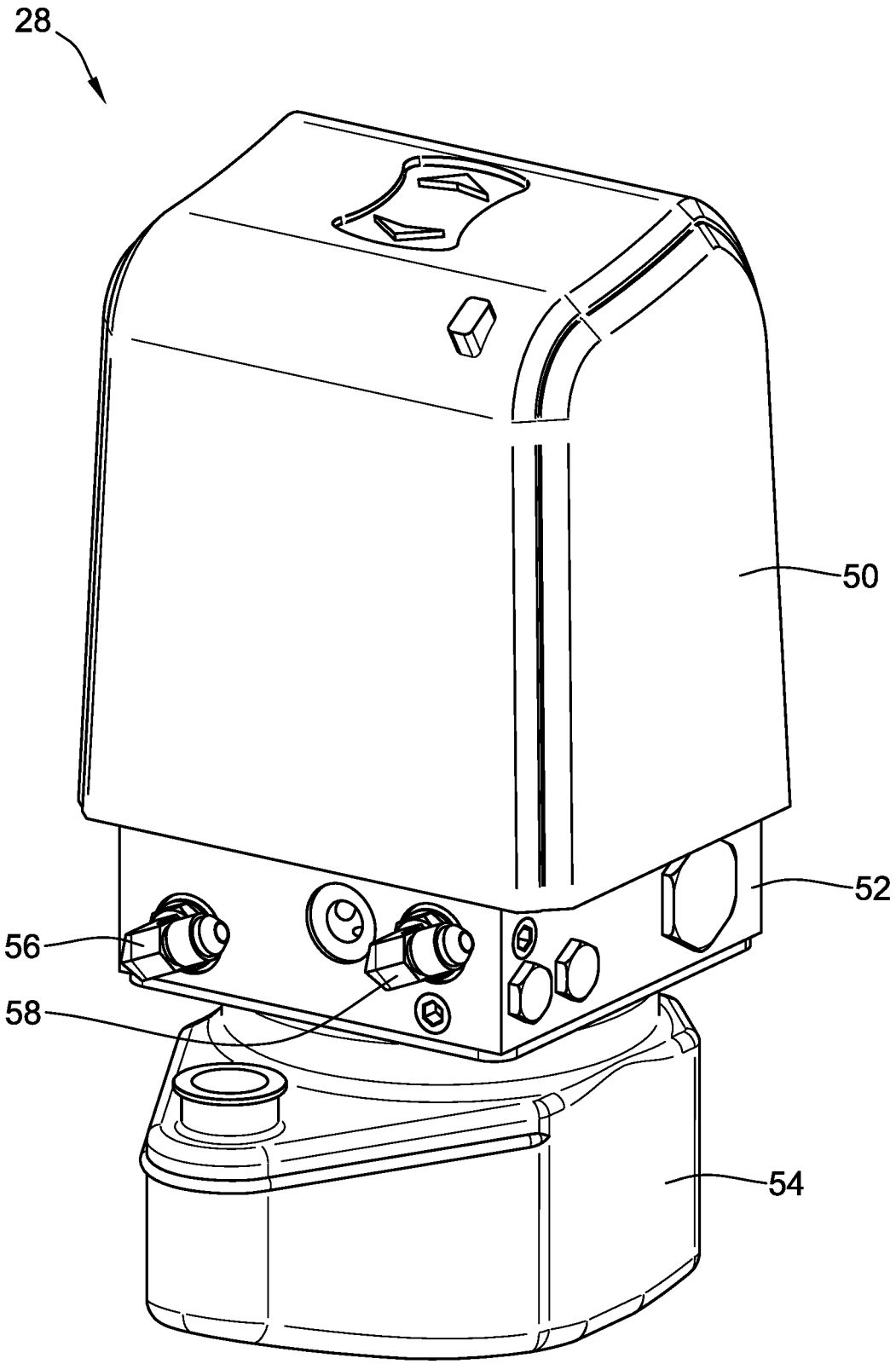
FIG. 4 is a perspective view of a hydraulic control arrangement of the system of FIG. 1.

Turning now to FIG. 4, a physical embodiment of HCA 28 shown. HCA 28 includes a bi-directional pump 50, a flow manifold 52, and a reservoir 54 for containing hydraulic fluid used by the system. As introduced above, bi-directional pump 50 includes a motor for driving pump 50. Any motor capable of driving a bi-directional pump is sufficient. Flow manifold 52 defines two ports 56, 58 each of which are connected to actuator 40 (See FIG. 2) to operate the same. Indeed, actuator 40 is a dual acting hydraulic actuator such that fluid pressure from one of ports 56, 58 acts upon one side of a piston 90 (See FIG. 6) and fluid pressure from the other one of ports 56, 58 acts on the other side of this piston.

Figure 5:
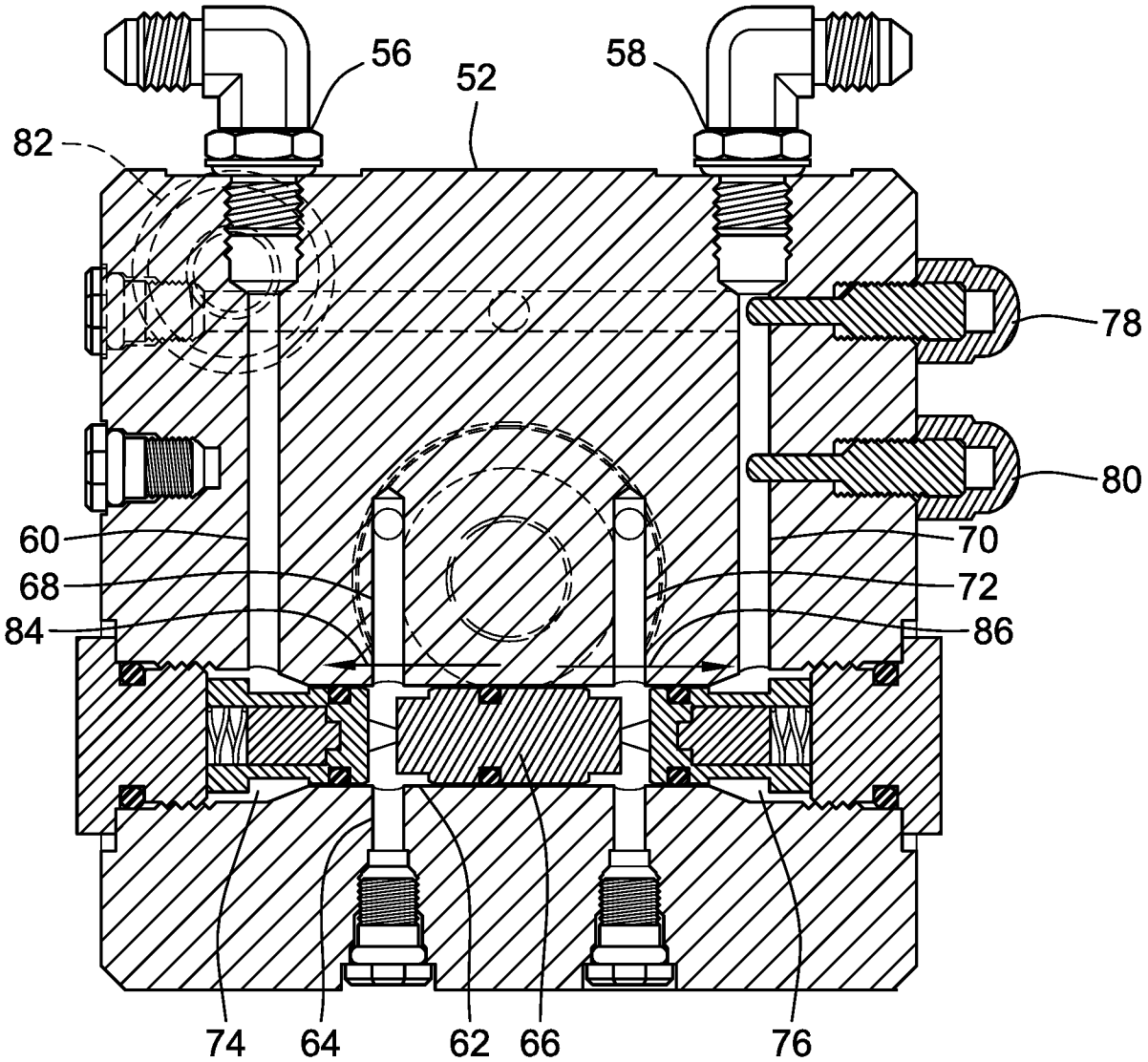
FIG. 5 is a cross section taken through a flow manifold of the hydraulic control arrangement of FIG. 4.

Flow manifold 52 includes a number of passageways and ports to convey fluid into and out of each of ports 56, 58. With reference to FIG. 5, the same illustrates a cross section taken through flow manifold 52. Fluid is supplied to and from flow manifold 52 from reservoir 54 by reservoir lines 68, 72. Each of reservoir lines 68, 72, are in fluid communication with a flow passage 62. Flow passage 62 includes a movable shuttle spool 66 which subdivides flow passage 62 into two separate variable volumes based on a position of shuttle spool 66 within flow passage 62. A first and a second check valve 74, 76 are also contained within flow passage 62. A supply passage 60 extends from flow passage 62 in the area of check valve 74 to port 56. A supply passage 70 extends from flow passage 62 in the area of check valve 76 to port 58.

Check valve 74 is arranged to allow fluid pressure to open check valve 74 when flowing from reservoir line 68 to supply passage 60 and to allow the spring force of this check valve and fluid pressure to close check valve 74 when flowing in the opposite direction. Check valve 76 is arranged to allow fluid pressure to open check valve 76 when flowing from reservoir line 72 to supply passage 70 fluid and to allow the spring force of this check valve and fluid pressure to close check valve 76 when flowing in the opposite direction.

As mentioned above, actuator 40 (See FIG. 6) is a dual-acting hydraulic actuator. Fluid pressure supplied from port 56 acts on one side of a piston 90 of actuator 40, while fluid pressure supplied from port 58 acts upon the other side of this piston 90. As such, supplying fluid out of one of ports 56, 58 and returning fluid into the other one of ports 56, 58 changes the length of actuator 40 to create an actuating force.

Check valves 74, 76 are positioned such that fluid cannot flow back into flow passage 62 from either of supply lines 68, 70. This configuration is advantageous in that it prevents unintentionally changes in length of actuator 40. Indeed, it is possible after placing shallow water anchor 20 into a deployed position that the water level may change due to waves, etc., causing a back pressure to be exerted against actuator 40. Check valves 74, 76 are arranged to prevent this back pressure from forcing fluid back into flow passage 62 and hence prevent an unintended change in the operating length of actuator 40.

However, it is necessary to open both check valves 74, 76 when fluid flows out of ports 56, 58 and into the other one of ports 56, 68 to allow fluid to be returned to reservoir 54 from one side of piston 90 of actuator 40 (See FIG. 6) while fluid is supplied to the other side of piston 90 from reservoir 54. As stated above, however, check valves 74, 76 are arranged to allow fluid flow back into flow passage 62 from either of supply lines 60, 70 when check valves 74, 76 are held open. As an example, as fluid flows from reservoir 54 via reservoir line 72 to flow passage 62, this fluid pressure will open check valve 76 and allow fluid to flow along supply line 70 and out of port 58 to actuator 40. Simultaneously, however, fluid is also flowing back into port 56 and along supply line 60. Check valve 74 will be forced into a closed position by its internal biasing spring and this fluid pressure, and as such, check valve 74 must be mechanically opened to allow fluid to continue to flow into flow passage 62 from supply line 60.

Shuttle spool 66 is arranged to achieve the aforementioned mechanical opening of check valves 74, 76 as needed. Indeed, shuttle spool 66 is movable in directions 84, 86 within flow passage 62. The same fluid pressure which opened check valve 76 also biases shuttle spool 66 in direction 84 such that it contacts check valve 74 to open the same. When flow is direction in the opposite direction to that described above, i.e. fluid is flowing out of port 56 and into port 58, shuttle spool 66 will be moved in direction 86 to bias check valve 76 into an open position. In this way, while pump 50 (See FIG. 4) is moving fluid to and from hydraulic actuator 40, both check valves 74, 76 are open. One check valve 74, 76 is opened via fluid pressure, while the other one of check valves 74, 76 is opened mechanically by shuttle spool 66.

Still referring to FIG. 5, HCA 28 may also include a pressure transducer 82 to sense a fluid pressure within flow manifold 52. Such a configuration allows for closed loop control of fluid pressure supplied to actuator 40. It should be noted, however, that closed loop control of shallow water anchor 20 is also possible in the absence of a pressure transducer 82 by monitoring the current supplied to pump 50 while it is operating. One advantage of also incorporating a pressure transducer 82 is that it provides a feedback signal based on pressure in the system, regardless of whether or not pump 50 is operating. Pressure transducer 82 is exposed to fluid pressure from a transducer line which is in fluid communication with supply line 70.

Figure 6:
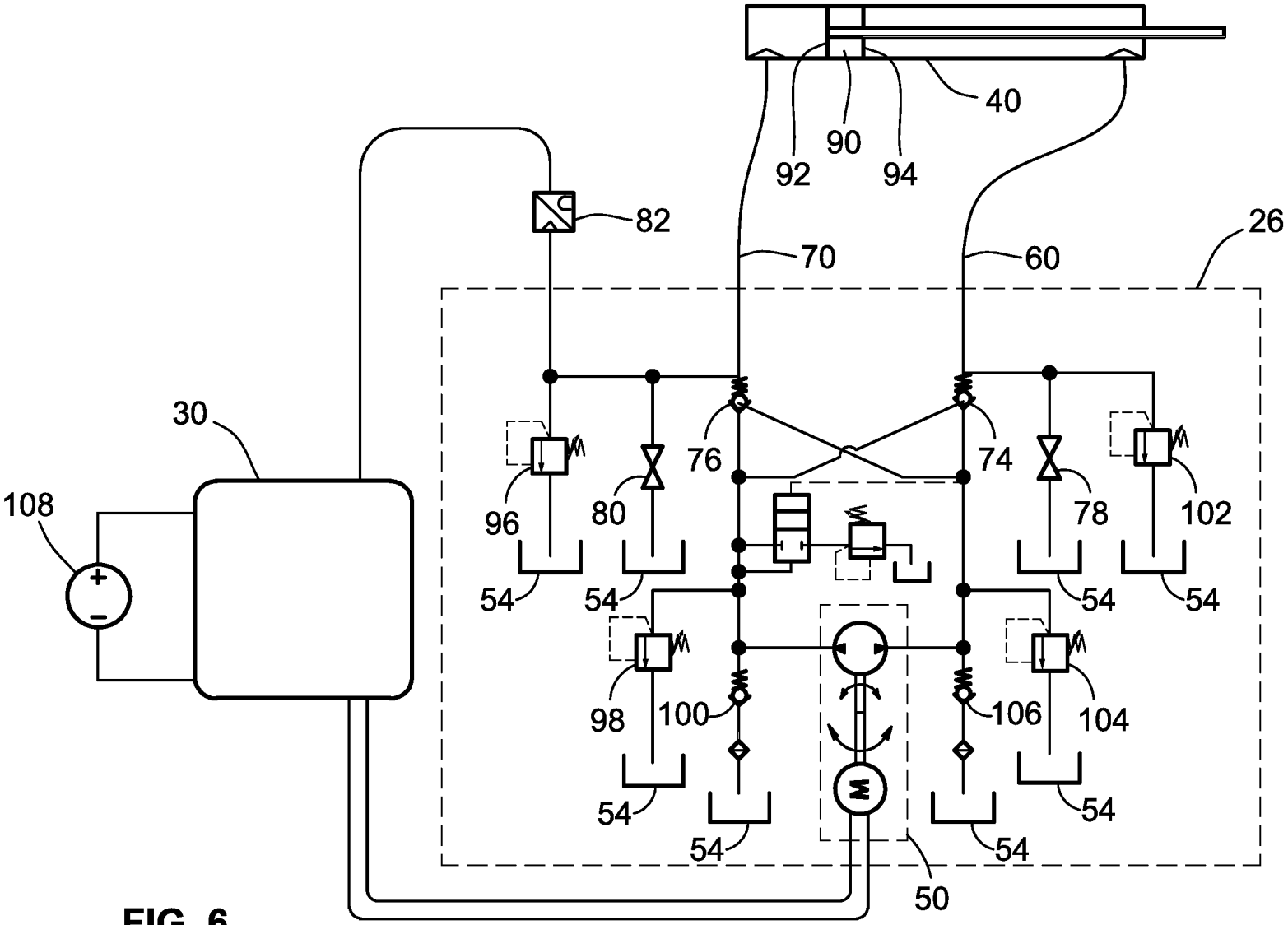
FIG. 6 is a schematic view of the hydraulic control arrangement of FIG. 4, in the context of a hydraulic actuator of the shallow water anchor shown in FIG. 1 and a controller of the system of FIG. 1.

FIG. 6 illustrates HCA 28 in schematic form. Controller 30 receives a signal from pressure transducer 82 and also supplies power to pump 50. As such, controller 30 can also monitor the current supplied to pump 50. In embodiments which do not include a pressure transducer 82, the current signal to pump 50 alone is monitored by controller 30 for closed loop control of shallow water anchor 20.

As may be seen in FIG. 6, piston 90 includes a first side 92 which is acted upon by fluid pressure supplied via supply line 70, and a second side 94 which is acted upon by fluid pressure from supply line 60. A greater fluid pressure in supply line 60 than in supply line 70 decrease the operating length of actuator 40, while a greater fluid pressure in supply line 70 than in supply line 60 increased the operating length of actuator 40. A first flow path thus extends from reservoir 54, to flow passage 62 via reservoir line 68, and from flow passage 62 to supply line 60 ultimately to face 94 of piston 90. A second flow path extends from reservoir 54, to flow passage 62 via reservoir line 72, and from flow passage 62 to supply line 70 ultimately to face 92 of piston 90. Check valve 74 is arranged along the first flow path, while check valve 76 is arranged along the second flow path.

Beyond the componentry already described in FIG. 5, FIG. 6 also illustrates in schematic form additional componentry which may be included with HCA 28. For example, a thermal relief valve 96, 102 may be arranged along each of the first and second flow paths as shown. Further, a high pressure relief valve 98, 104, may also be included along the first and second flow paths.

Thermal relief valves 96, 102 function to limit the amount of fluid pressure that may be present in either of the first and second flow paths, particularly when the system is static, i.e. pump 50 is not running. This limiting feature prevents an over-pressure situation that could arise as a result of outside influences attempting to force shallow water anchor 20 out of its static configuration. For example, waves or other obstacles could cause additional force to be exerted by four-bar linkage 24 (See FIG. 1) on actuator 40. In this instance, if the pressure exceeds a set valve, fluid will be vented back to reservoir 54 via one or thermal relief valves 96, 102.

Similarly, high pressure relief valves 98, 104, function to limit the amount of pressure which may be present in the first and second flow paths. In particular, high pressure relief valve 104 limits the amount of pressure which may be transferred by pump 50 to the first flow path, while high pressure relief valve 98 limits the amount of pressure which may be transferred by pump 50 to the second flow path. In the event of an over-pressure situation, fluid is vented by either high pressure relief valve 98, 104 back to reservoir 54. Because the high pressure relief valves 98, 104, are upstream from their respectively associated check valves 74, 76, the pressure limiting function of these high pressure relief valves is only available while pump 50 is running. Over-pressure limiting downstream from check valves 74, 76 is achieved by the above-described thermal relief valves 96, 102.

A reservoir check valve 100, 106 may also be associated, respectively, with the first and second flow paths to prevent bleed back of fluid into reservoir 54. These "reservoir check valves" 100, 106 are distinct from the "check valves" 74, 76 already discussed. Additionally, a pair of bypass valves 78, 80 may also be included which may be used to bypass each check valve 74, 76, respectively, and allow fluid to flow back to reservoir 54 despite being downstream from check valves 74, 76 in their closed positions, and despite pump 50 not operating.

Figure 7:
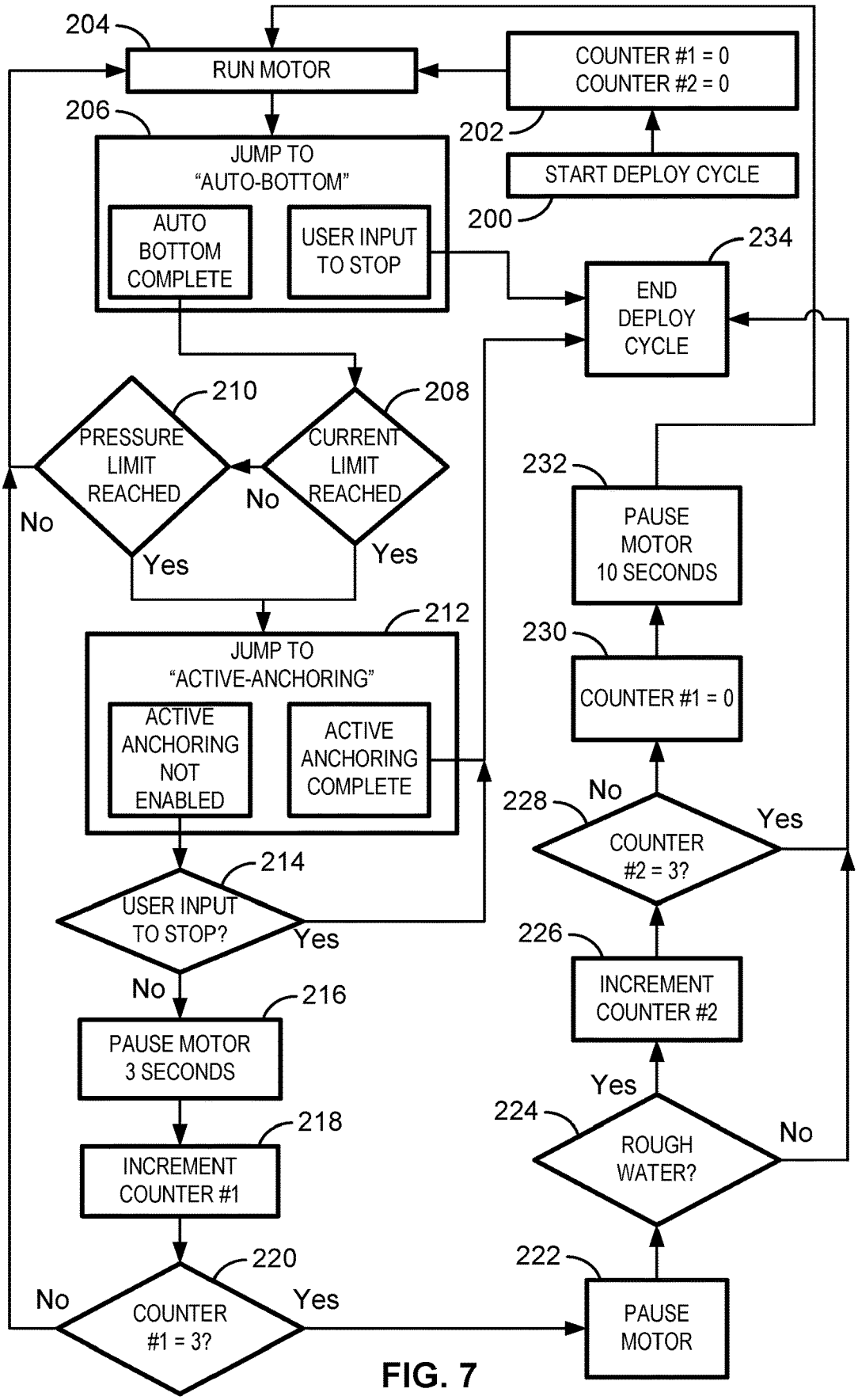
FIG. 7 is a flowchart depicting the operation of a deploy cycle of the shallow water anchor of FIG. 1.

Turning now to FIG. 7, the same illustrates a flowchart of the operation of an embodiment of a typical deploy cycle of anchor 20. At step 200, the deploy cycle is initiated. This may be done using a manual control such as a button or switch located on anchor 20, or using a manual control of another device such as a remote control. Further, the manual control in this instance may be a virtual switch or button contained in an application associated with anchor 20.

After initiation at step 200, counter 1 and counter 2 are set to zero at step 202. As will discussed below, these counters are used for tracking the number of times at least one of a current or pressure limit are met when attempting to deploy the anchor. These limit thresholds are indicative of when anchor 20 has encountered the bottom of the body of water in which it is situated in.

At step 204, the pump of HCA 28 begins to pump hydraulic fluid to cause anchor 20 to begin transitioning from its stowed position to its deployed position.

At step 206, at least one of a pressure or a current limit is determined. As will be discussed below relative to FIG. 8, the pressure and current limit may be determined by referring to a lookup table associated with controller 30 based on predefined user inputs. Alternatively, the pressure and current limit may be determined dynamically based current and pressure signals received as anchor 20 begins to encounter the bottom or another obstacle. It should be noted that the system may determine a pressure limit, or current limit, or both. The description associated with FIGS. 7-10 assumes both a pressure limit and a current limit are being determined and monitored, but it is also contemplated herein to provide feedback control of anchor 20 using only one of the aforementioned limits.

At steps 208, 210, controller 30 determines whether the pressure and the current limit identified in step 206 has been reached. In those embodiments of anchor 20 which do not include pressure transducer 82, controller 30 monitors the electrical current drawn by pump 50 of HCA 28 at step 208 alone. In those embodiments including pressure transducer 82, controller 30 monitors both the aforementioned electrical current at step 208 as well as the hydraulic fluid pressure detected by pressure transducer 82 at step 210.

If the aforementioned limits are not met, then steps 204 through 210 are repeated. Once the aforementioned limits are met, anchor 20 repeats the above process of extending anchor 20, determining a pressure and/or a current limit, and monitoring for when that pressure and/or current limit is reached. The determination of how the aforementioned repeating is done is governed by step 212. Step 212 checks for whether or not an "active anchoring" mode is enabled. This active anchoring mode is described below relative to FIG. 9.

In the event active anchoring is not enabled, then the process moves to step 214 in which a check to make sure the user has not stopped the deployment process by, for example, manipulation of the same or a different user input used at step 200. If a user input to stop is received the process moves to step 234 in which the deployment cycle is completed. If a user input is not received at step 214, the system then pauses pump 50 for three seconds at step 216 and increments counter 1 by one at step 218.

The value of counter 1 is then analyzed at step 220. Assuming counter 1 is not equal to or greater than three, the process loops back to step 204. Steps 204, 206, 208, 210, 214, 216, and 218 are repeated until counter 1 is equal to three. In other words, the steps of extending (step 204), determining at least one of a current and a pressure limit (step 206), and monitoring for whether these limits are met (steps 208, 210) are repeated an additional two times after their first instance. Of course, the value of counter 1 may be modified to accommodate fewer or greater cycles.

From the above, it will be readily appreciated that, when active anchoring is not enabled, anchor 20 makes at least three attempts at forcing anchor element 26 into the bottom of the body of water it is situated in to ensure a sufficient anchoring force is achieved. This sufficient anchoring force is determined by reaching the limits at steps 208, 210. Indeed, when anchor element 26 encounters an obstruction or the bottom of the body of water, pump 50 will continue to pump fluid against a greater resistance, which will cuase an increase in the current draw of pump 50. The same holds true for the pressure of fluid delivered to actuator 40 to continue to extend anchor 20 against this resistance.

Anchor 20 may also make additional attempts if a rough water mode at step 224 is also enabled. Indeed, after counter 1 has a valve of three at step 220, the process then moves to step 222 where pump 50 pauses. If rough water mode is not enabled at step 224, the deployment cycle ends at step 234. If, however, rough water mode is enabled at step 224, counter 2 is incremented by one at step 226. If counter 2 is less than three at step 228, counter 1 is set to zero at step 230, and pump 50 is paused for ten seconds at step 232. The process then loops back to step 204 and the above steps are repeated again. In particular, the process of extending anchor 20, determining a current and pressure limit, and monitoring for whether or not these limits are met are repeated an additional six times, i.e. until counter 2 equals 3 as step 228. Once counter 2 equals 3, the deployment cycle ends at step 234.

Figure 8:
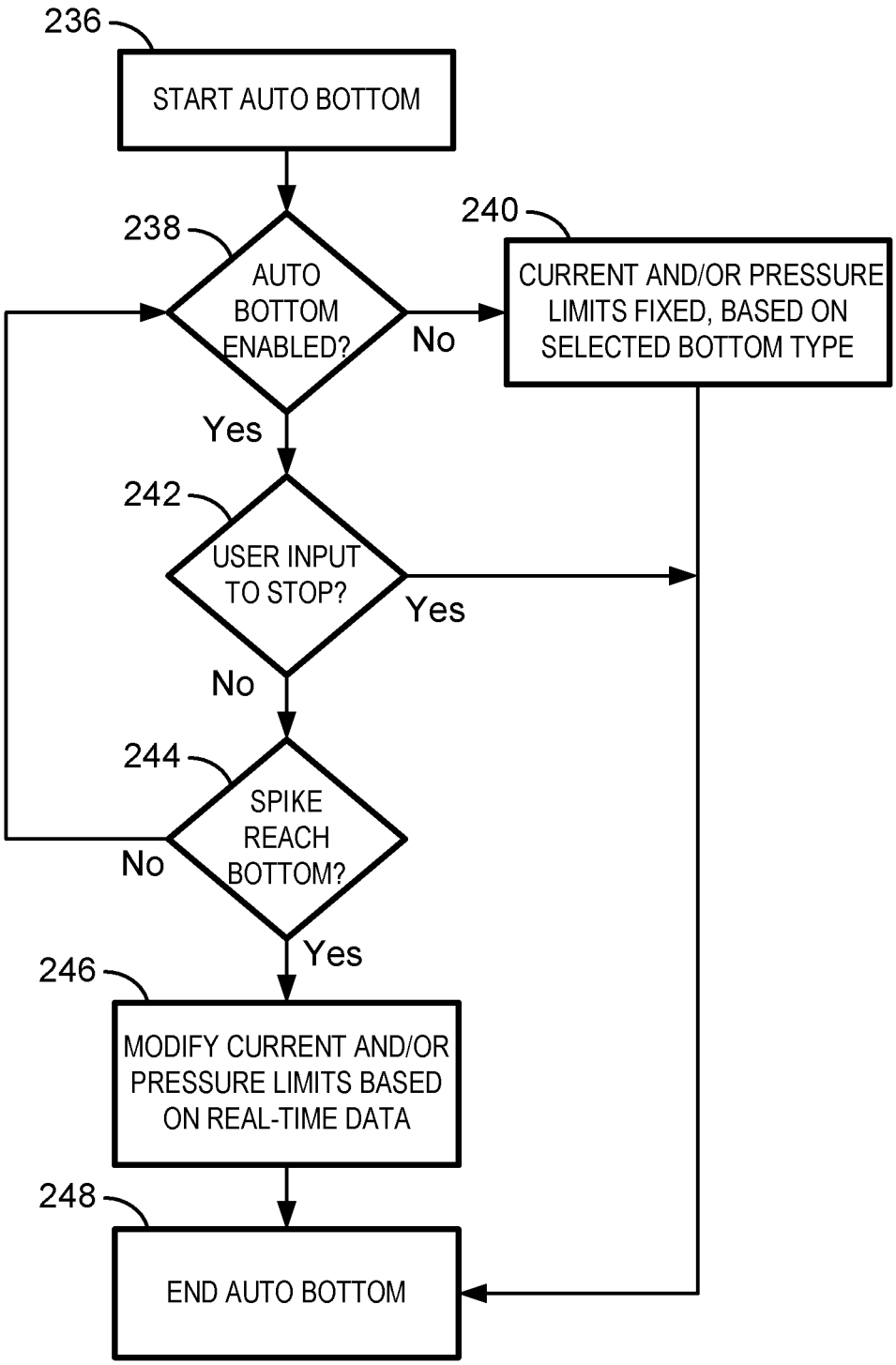
FIG. 8 is a flowchart depicting the operation of an auto-bottom portion of the deploy cycle of FIG. 7 in detail.

Turning now to FIG. 8, the same illustrates in greater detail step 206, i.e the step of determining at least one of a current and a pressure limit. Indeed, at step 206 the current limit and the pressure limit are determined based on whether an "auto-bottom" mode of anchor 20 is enabled or not. Indeed, if auto-bottom is not enabled at step 238, then the current and pressure limits are set at step 240 by reference to predetermined values of these limits based on user inputs. For example, a user may indicate using a user interface associated with controller 30 that the user is in a sand bottom lake. This will govern the permissible current and pressure limits. Any number of inputs may be considered, e.g. bottom type, desired anchor depth, vegetation present, etc. Once these limits are determined, they may then be monitored as steps 208, 210 shown in FIG. 7.

If, however, auto-bottom mode is enabled at step 238, the pressure and current limits are dynamically determined based on the magnitude of the rate of change of the electrical current drawn by pump 50 and/or a hydraulic fluid pressure sensed in the hydraulic loop. When this mode is enabled, an initial check for a stop command from the user is conducted at step 242. As anchor element 26 reaches the bottom (or an obstruction) to cause a change in current draw and a change in pressure at step 244, the rates of change of these values are captured. Based on the magnitude of these rates of change, the current and pressure limits are adjusted at step 246. These limits may be increased or decreased incrementally based on the magnitudes of the rates of change.

For example, a rapid rate of change could cause a small increment in the current and pressure limits at step 246, whereas a slow rate of change could cause a large increment in the current and pressure limits at step 246. The opposite could also be true at step 246 in that a large rate of change could also cause a relatively large increment to the pressure and current limit value. The Applicant has found that a rapid rate of change typically indicates harder bottom types which use higher current and pressure limits, while slower rates of change typically indicate softer bottom types which use lower current and pressure limits. In any case, the particular incremental increases or decreases of the limit values at step 246 are determined dynamically based on the magnitude of the rates of change as anchor element 26 begins to encounter the bottom or an obstruction. Once these limits are determined, they may then be monitored as steps 208, 210 shown in FIG. 7.

Figure 9:
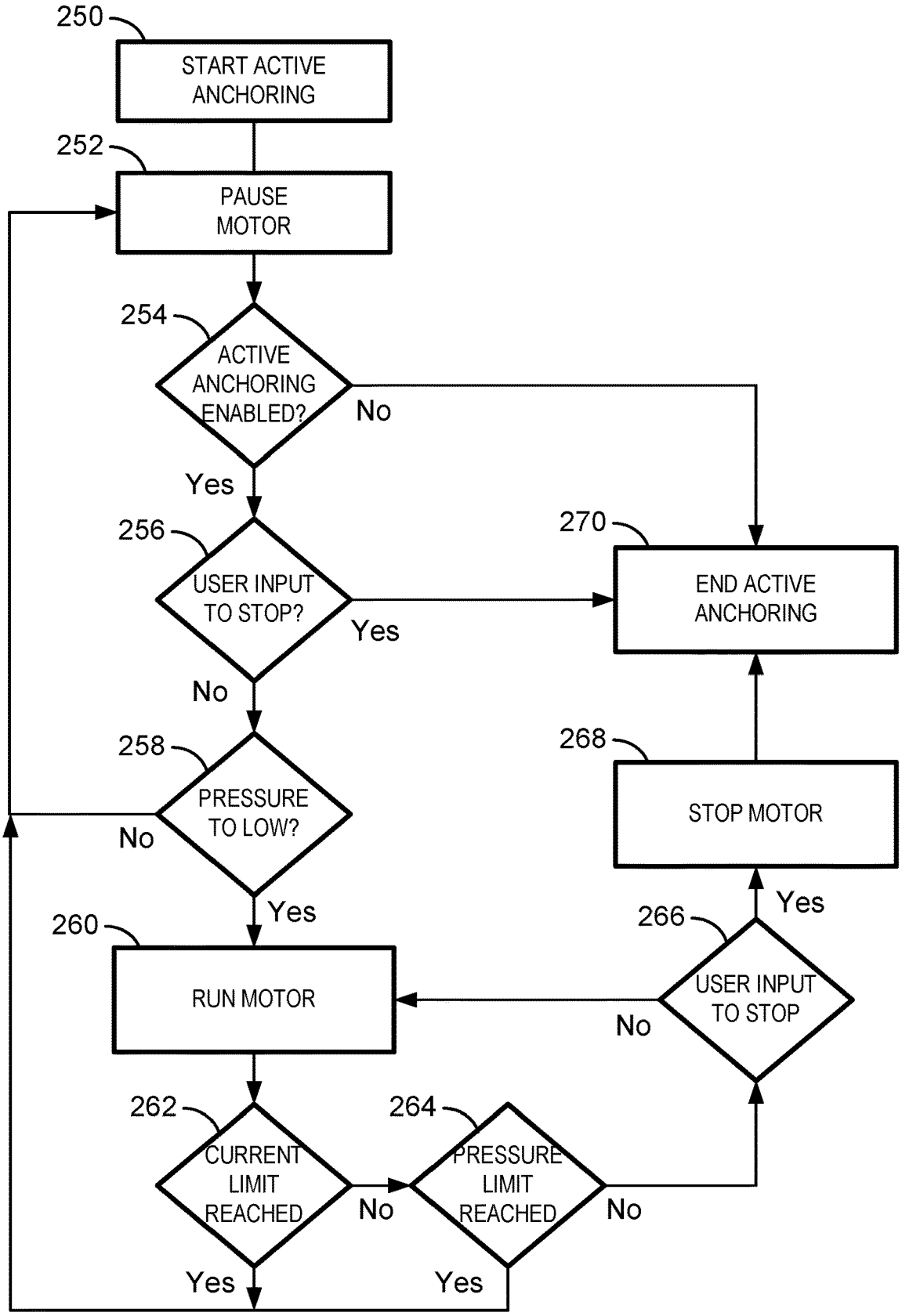
FIG. 9 is a flowchart depicting the operation of an active anchoring portion of the deploy cycle of FIG. 7 in detail.

FIG. 9 illustrates the above introduced active anchoring mode at step 212 in FIG. 7 in greater detail. As already mentioned above, in the event active anchoring is not turned on, the current and pressure limits established at step 206 are reached a predetermined number of times based on the value of counter 1, and optionally counter 2 if rough water mode is turned on. However, with active anchoring mode enabled, anchor 20 will repeatedly make anchoring attempts until the pressure and current limits determined at step 206 are met until active anchoring is turned off. This allows anchor 20 to actively attempt to achieve a desired anchoring force in response to outside influences such as waves, settling, etc.

Indeed, with active anchoring enabled at step 254 and absent a user input to stop at step 256, a check is made as to whether the hydraulic fluid pressure is too low at step 258, i.e. whether the pressure value sensed is too low compared to the pressure limit already set at step 206. As practical example, if anchor element 26 becomes dislodged from the bottom the fluid pressure in actuator 40 will reduce. If this is the case, pump 50 is turned back on to drive this pressure value back to the pressure limit and/or to drive the current value drawn by pump 50 back to the current limit while pump 50 is operating. Once either of these values are achieved at steps 262, 264 and assuming a user stop command has not been received at step 266, the loop repeats beginning at step 252. In other words, controller 30 continues to actively monitor system fluid pressure for the next occurrence where the fluid pressure sensed at step 258 is too low. This process of active anchoring will continue until a user provides a stop command at step 256 or step 266.

Figure 10:
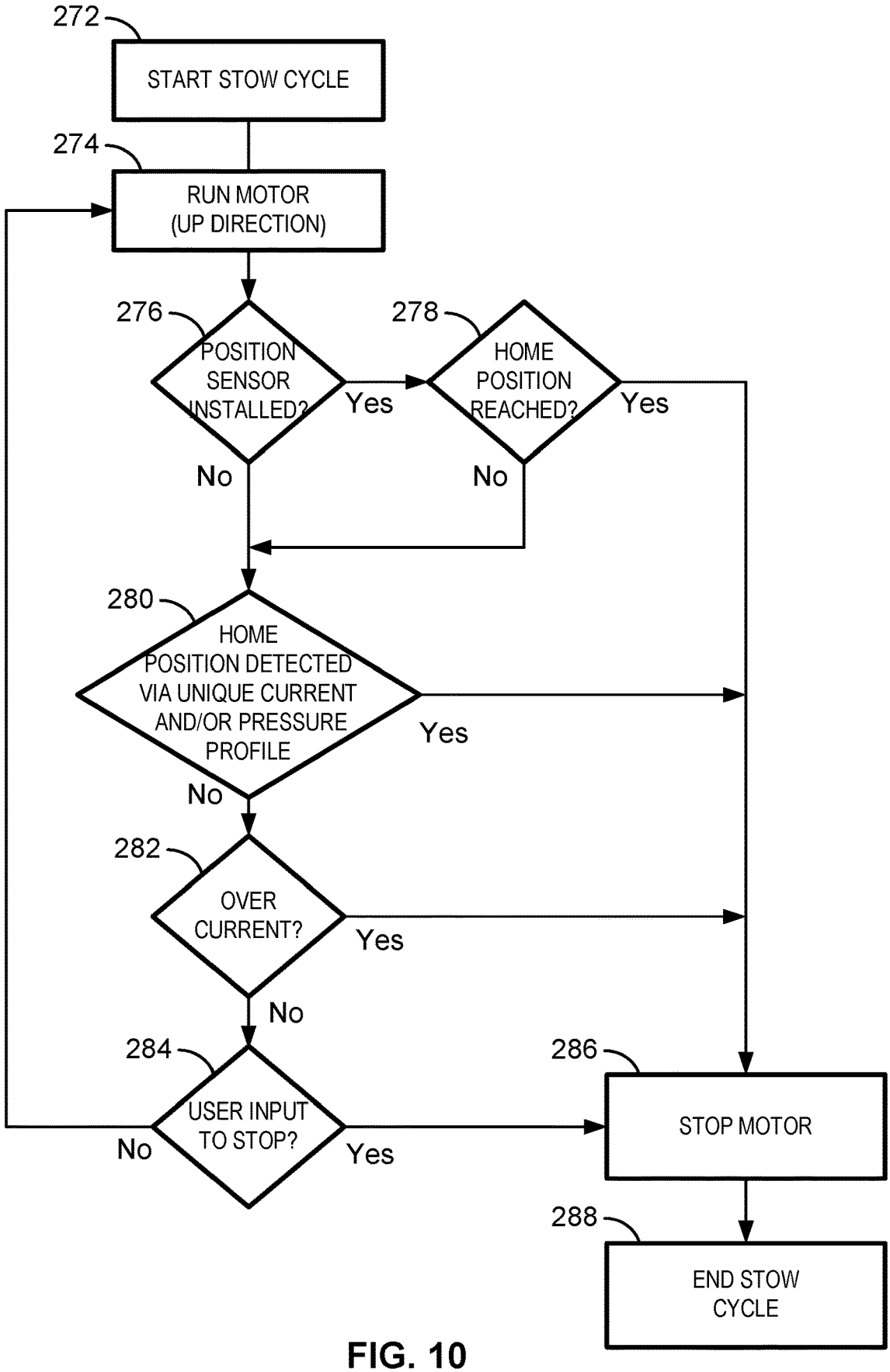
FIG. 10 is a flowchart depicting a stow cycle of the shallow water anchor of FIG. 1.

Turning now to FIG. 10, the stow process is shown in flow chart form. To stow, first a stow command must be received at step 272. This command may be received or input in the same manner as the deploy command mentioned above relative to step 200 of FIG. 7. Pump 50 will then run to shorten the length of actuator 40. This will continue until a home position is detected or there is a user input to stop. Detection of this home position may be achieved via a home position sensor installed in anchor 20 at steps 276, 278, and/or may be determined by a predetermined current draw by pump 50 and/or a pressure profile of hydraulic fluid flowing to or from actuator 40 at step 280, and/or a base current limit. In embodiment utilizing pressure transducer 82, current and pressure may be monitored. In embodiments without pressure transducer 82, current only may be monitored.

Assuming there is no user command to stop at step 284, the process loops back to step 274 and repeats until the home position is achieved, which is the fully stowed position shown in FIG. 1.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shallow water anchor, comprising:

a four-bar linkage, having a first end configured for mounting to a watercraft;

at least one hydraulic actuator operably connected to the four-bar linkage for transitioning the shallow water anchor from a stowed position to a deployed position and from deployed position to a stowed position;

an anchoring element mounted at a second end of the four-bar linkage;

a hydraulic control arrangement operably coupled to the hydraulic actuator to control said hydraulic actuator, the hydraulic control arrangement including a pressure transducer to provide closed loop control of the shallow water anchor; and wherein the mounting arm and anchor arm each include a plurality of interior support ribs.

2. A shallow water anchor, comprising:

a four-bar linkage, having a first end configured for mounting to a watercraft;

at least one hydraulic actuator operably connected to the four-bar linkage for transitioning the shallow water anchor from a stowed position to a deployed position and from deployed position to a stowed position;

an anchoring element mounted at a second end of the four-bar linkage;

a hydraulic control arrangement operably coupled to the hydraulic actuator to control said hydraulic actuator, the hydraulic control arrangement including a pressure transducer to provide closed loop control of the shallow water anchor; and wherein the mounting arm and anchor arm each include a plurality of interior support ribs.

3. The shallow water anchor of claim 2, wherein the hydraulic actuator is a double-acting cylinder hydraulic actuator.

4. The shallow water anchor of claim 2, wherein the four-bar linkage comprises:

a first arm;

a second arm arranged in parallel to the first arm;

a mounting arm connected to the first and second arms, the mounting arm defining the first end of the four-bar linkage; and an anchor arm arranged in parallel to the mounting arm and connected to the first and second arms, the anchor arm defining the second end of the four-bar linkage.

5. The shallow water anchor of claim 4, wherein the hydraulic actuator is connected to the first arm and the second arm.

6. The shallow water anchor of claim 5, wherein an interior space is defined between the first and the second arms in the stowed position and in the deployed position, and wherein the hydraulic actuator is contained within the interior space.

7. The shallow water anchor of claim 6, further comprising at least one stabilization bar between the first and second arms within the interior space.

8. The shallow water anchor of claim 2, wherein the pump is operable to convey hydraulic fluid from the reservoir through the flow manifold along a first flow path and a second flow path.

9. The shallow water anchor of claim 8, wherein the first flow path includes a first check valve arranged to prevent a flow of hydraulic fluid from the hydraulic actuator back towards the reservoir along the first flow path, and wherein the second flow path includes a second check valve arranged to prevent a flow of hydraulic fluid from the hydraulic actuator back towards the reservoir along the second flow path, wherein a shuttle spool is interposed between the first and second check valves within the flow manifold, the shuttle spool operable to bias one of the first or second check valves open when the other one of the first or second check valves is opened due to a hydraulic fluid pressure.

10. The shallow water anchor of claim 9, wherein the pressure transducer is in fluid communication with at least one of the first and second flow paths to detect a hydraulic fluid pressure.

11. The shallow water anchor of claim 10, wherein the pressure transducer is mounted to the flow manifold.

12. The shallow water anchor of claim 10, wherein the pressure transducer is configured to provide a signal to a controller for closed loop feedback control of the shallow water anchor.

13. A shallow water anchor, comprising:

a four-bar linkage, having a first end configured for mounting to a watercraft;

at least one hydraulic actuator connected to the four-bar linkage;

an anchoring element mounted at a second end of the four-bar linkage;

a hydraulic control arrangement operably coupled to the hydraulic actuator to control said hydraulic actuator, the hydraulic control arrangement comprising a pump, a flow manifold, and a reservoir, the pump operable to convey hydraulic fluid from the reservoir through the flow manifold along a first flow path and a second flow path, wherein the first flow path includes a first check valve arranged to prevent a flow of hydraulic fluid from the hydraulic actuator back towards the reservoir along the first flow path, and wherein the second flow path includes a second check valve arranged to prevent a flow of hydraulic fluid from the hydraulic actuator back towards the reservoir along the second flow path; and wherein a shuttle spool is interposed between the first and second check valves within the flow manifold, the shuttle spool operable to bias one of the first or second check valves open when the other one of the first or second check valves is opened due to a hydraulic fluid pressure.

14. The shallow water anchor of claim 13, wherein the four-bar linkage comprises:

a first arm;

a second arm arranged in parallel to the first arm;

a mounting arm connected to the first and second arms, the mounting arm defining the first end of the four-bar linkage; and an anchor arm arranged in relative to the mounting arm and connected to the first and second arms, the anchor arm defining the second end of the four-bar linkage.

15. The shallow water anchor of claim 13, further comprising a controller for monitoring at least one signal corresponding to a current supplied to the pump or a fluid pressure along one of the first and second flow paths, wherein the hydraulic control arrangement further comprises a pressure transducer, wherein the pressure transducer is in fluid communication with at least one of the first and second flow paths to detect a hydraulic fluid pressure, the pressure transducer providing the at least one signal corresponding to the fluid pressure in at least one of the first and second flow paths.

16. The shallow water anchor of claim 15, wherein the controller is configured to control operation of the pump of the hydraulic control arrangement based on the at least one signal received.

17. The shallow water anchor of claim 13, the hydraulic control arrangement comprises a first thermal relieve valve and a first high pressure relief valve arranged in fluid communication with the first flow path, and a second thermal relief valve and a second high pressure relief valve in fluid communication with the second flow path.

18. The shallow water anchor of claim 17, further comprising a first manual bypass valve in fluid communication with the first flow path, and a second manual bypass valve in fluid communication with the second flow path.

19. A method of transitioning a shallow water anchor from a stowed position to a deployed position, the shallow water anchor comprising a four-bar linkage, an anchoring element coupled to the four-bar linkage, a hydraulic actuator coupled to the four-bar linkage to change a configuration of the four-bar linkage, and a hydraulic control arrangement for controlling the hydraulic actuator, the method comprising:

extending a length of the hydraulic actuator via a supply of hydraulic fluid from the hydraulic control arrangement until the anchoring element contacts a bottom surface;

determining at least one of a current limit and a pressure limit; and monitoring for whether or not at least one of the current limit or the pressure limit is met.

20. The method of claim 19, further comprising repeating, at least once, the steps of extending, determining, and monitoring, after at least one of the current limit or the pressure limit is met.

21. The method of claim 19, wherein the step of determining at least one of a current limit and a pressure limit includes identifying, with a controller, a rate of change in current or a rate of change in pressure.

22. The method of claim 21, wherein the step of determining at least one of a current limit and a pressure limit includes setting a current limit or a pressure limit based on a look-up table value stored in a memory of the controller.

23. The method of claim 21, wherein the step of determining at least one of a current limit and a pressure limit includes setting a current limit or a pressure limit based the magnitude of the rate of change in current or the rate of change in pressure.

24. The method of claim 20, wherein the step of repeating, at least once, the steps of extending, determining, and monitoring includes repeating a predetermined number of times based on a value saved in memory of the controller.

25. The method of claim 20, wherein the step of repeating, at least once, the steps of extending, determining, and monitoring includes initiating the step of repeating upon detection by the controller of a pressure value which is below a minimum pressure value.

* * * * *